US011309159B2

(12) United States Patent
Lai et al.

(10) Patent No.: US 11,309,159 B2
(45) Date of Patent: Apr. 19, 2022

(54) STRUCTURE OF EMITTER ELECTRODE FOR ENHANCING ION CURRENTS

(71) Applicant: ALES TECH INC., Kaohsiung (TW)

(72) Inventors: Wei-Chaio Lai, Citong Township (TW); Chun-Yueh Lin, Keelung (TW); Ing-Shouh Hwang, New Taipei (TW); Wei-Tse Chang, Taoyuan (TW); Ching-Yu Hsiao, Taoyuan (TW); Yu-Fong Yu, New Taipei (TW); Zong-Yu Yang, Jinning Township (TW)

(73) Assignee: ALES TECH INC., Kaohsiung (TW)

( * ) Notice: Subject to any disclaimer, the term of this patent is extended or adjusted under 35 U.S.C. 154(b) by 0 days.

(21) Appl. No.: 17/408,763

(22) Filed: Aug. 23, 2021

(65) Prior Publication Data

US 2022/0068583 A1 Mar. 3, 2022

Related U.S. Application Data

(60) Provisional application No. 63/069,813, filed on Aug. 25, 2020.

(51) Int. Cl.
*H01J 1/02* (2006.01)

(52) U.S. Cl.
CPC ..... *H01J 1/02* (2013.01)

(58) Field of Classification Search
CPC ..... H01J 1/02; H01J 27/02; H01J 29/04
See application file for complete search history.

(56) References Cited

U.S. PATENT DOCUMENTS 3,814,975 A * 6/1974 Wolfe ..... H01J 37/063 313/336
2003/0085645 A1* 5/2003 Terui ..... H01J 1/15 313/441
2015/0188295 A1* 7/2015 Zhang ..... H01T 19/00 250/288
2021/0159038 A1* 5/2021 Khursheed ..... H01J 9/025

OTHER PUBLICATIONS

Jon Orloff, Handbook of Charged Particle Optics Second Edition, 2009, 51 pages, CRC Press, Taylor & Francis Group, LLC.
Y. Kobayashi Y. Sugiyama, Y. Morikawa, K. Kajiwara and K. Hata, Experimental evaluation of the influence of shank shape of field ion emitter on the angular current density, Journal of Vacuum Science & Technology B (JVSTB), Mar./Apr. 2010, 5 pages, vol. 28, No. 2, American Vacuum Society.

* cited by examiner

*Primary Examiner* — Anne M Hines
(74) *Attorney, Agent, or Firm* — Karin L. Williams; Mayer & Williams PC

(57) ABSTRACT

The present invention discloses a structure of an emitter electrode for enhancing ion currents, including a tip end part and a shank part. The tip end part has a pinpoint, a first diameter, and a radius of curvature. A length of the tip end part with the shank part is from the pinpoint to a first position of the shank part and a distance between the first position and the pinpoint is 300 times the first diameter. The radius of curvature of the tip end part ranges from 50 nanometers to 5 micrometers. The first diameter is 2 times the radius of curvature.

5 Claims, 9 Drawing Sheets

STRUCTURE OF EMITTER ELECTRODE FOR ENHANCING ION CURRENTS

BACKGROUND OF THE INVENTION

1. Field of the Invention

The present invention relates to a structure, particularly to a structure of an emitter electrode for enhancing ion currents.

2. Description of the Related Art

Gas field ions are generated by gas atoms and gas molecules ionized in an electrical field above a surface of an emitter electrode. The gas atoms and the gas molecules are originally of electrical neutrality. When the gas atoms and the gas molecules approach the emitter electrode in a pin shape, the gas atoms and gas molecules are attracted and polarized by the electrical field and captured because of the heat exchange principle. Ultimately, the gas atoms and the gas molecules are attracted to a pinpoint of the emitter electrode because of a potential energy well. After that, the gas atoms and the gas molecules attracted to the pinpoint of the emitter electrode ionize as the gas field ions in the electrical field are above the pinpoint. In other words, the larger the effective captured gas area is, the higher the ion currents are. Thereby, the structure of the emitter electrode will affect cumulation of the gas field ions.

As shown in FIG. 5A to FIG. 5E, FIG. 5A is a schematic diagram of a structure of a common emitter electrode 1. FIG. 5B is the enlarged image of the electrode 1 with a tip end part 11 and a shank part 12 of FIG. 5A. FIG. 5C is the enlarged image of the shank part 12 at one angle θ. FIG. 5D is the enlarged image of the shank part 12 at another angle θ. FIG. 5E is the schematic diagram for the shank part 12 at the different angles θ at the Helium pressure related to the ion currents, wherein the angle θ is defined as an intersection angle formed by the inclined line extended from the turning point of the radius of curvature R to the point corresponding to the diameter of the shank part 12 and the horizontal extension line extended from the turning point of the radius of curvature R. According to the above figures, the smaller the angle θ of the shank part 12 of the emitter electrode 1 is, the higher the ion currents are.

Thereby, since to increase the ion currents relates to the structure of the emitter electrode, how to design the structure of the emitter electrode to enhance the ion current is an urgent subject to tackle.

SUMMARY OF THE INVENTION

For the problems mentioned above, the present invention discloses a structure of the emitter electrode for enhancing ion currents, including a tip end part and a shank part. The tip end part is formed at a front end of the structure of the emitter electrode and has a pinpoint, a first diameter, and a radius of curvature. The shank part is formed in the rear of the tip end part at the front end of the structure of the emitter electrode. A length of the tip end part with the shank part is from the pinpoint to a first position of the shank part and a distance between the first position and the pinpoint is 300 times the first diameter. The radius of curvature of the tip end part ranges from 50 nanometers to 5 micrometers. The first diameter is 2 times the radius of curvature. Thereby, the ion currents generated by the structure of the emitter electrode of the present invention can be enhanced.

As mentioned above, the structure of the emitter electrode of the present invention has the features including a large radius of curvature of the tip end part, and a long length and a flat angle of the shank part. Thereby, the ion currents can be significantly increased from the scale of pico-amperes to the scale of nano-amperes.

DETAILED DESCRIPTION OF THE INVENTION

Figure 1A:
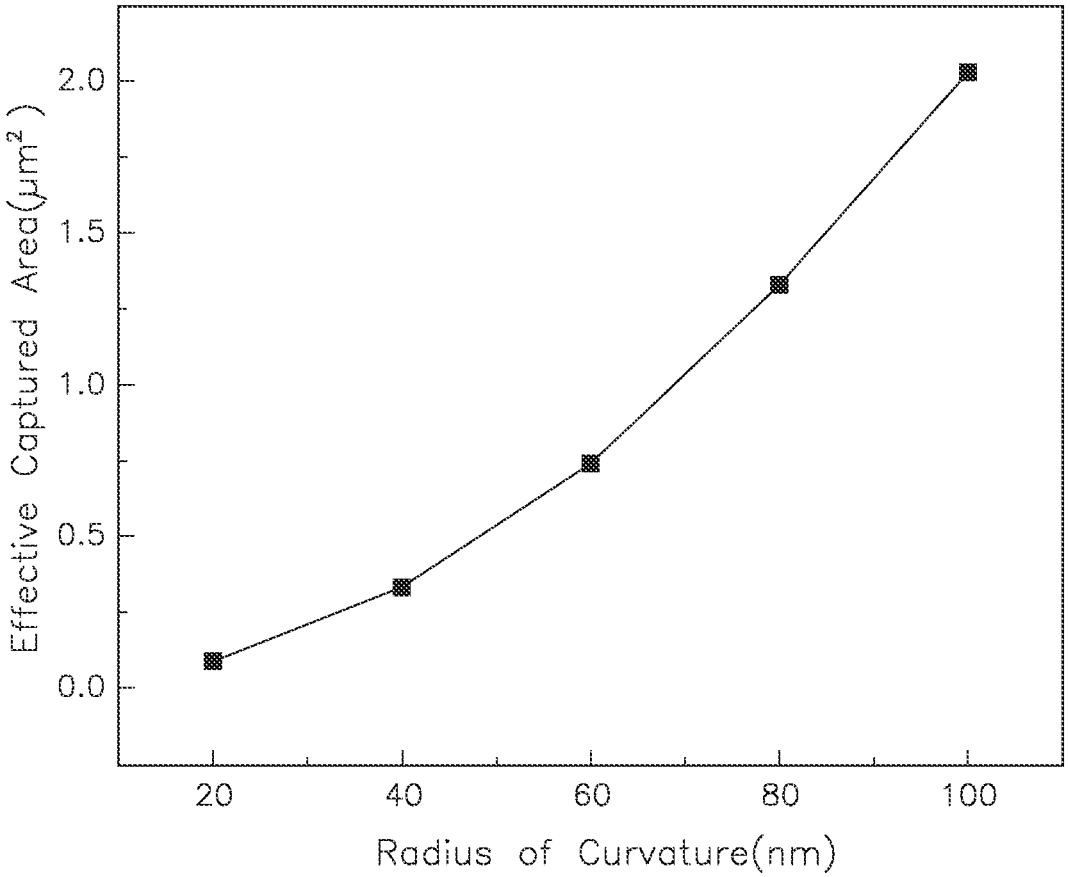
FIG. 1A is the schematic diagram of the radius of curvature related to the effective captured gas area.

Referring to FIG. 1A, FIG. 1A is the schematic diagram of the radius of curvature related to the effective captured gas area. FIG. 1A shows that the larger the radius of curvature of the tip end part is, the larger the effective captured area is and the higher the ion currents are.

Figure 1B:
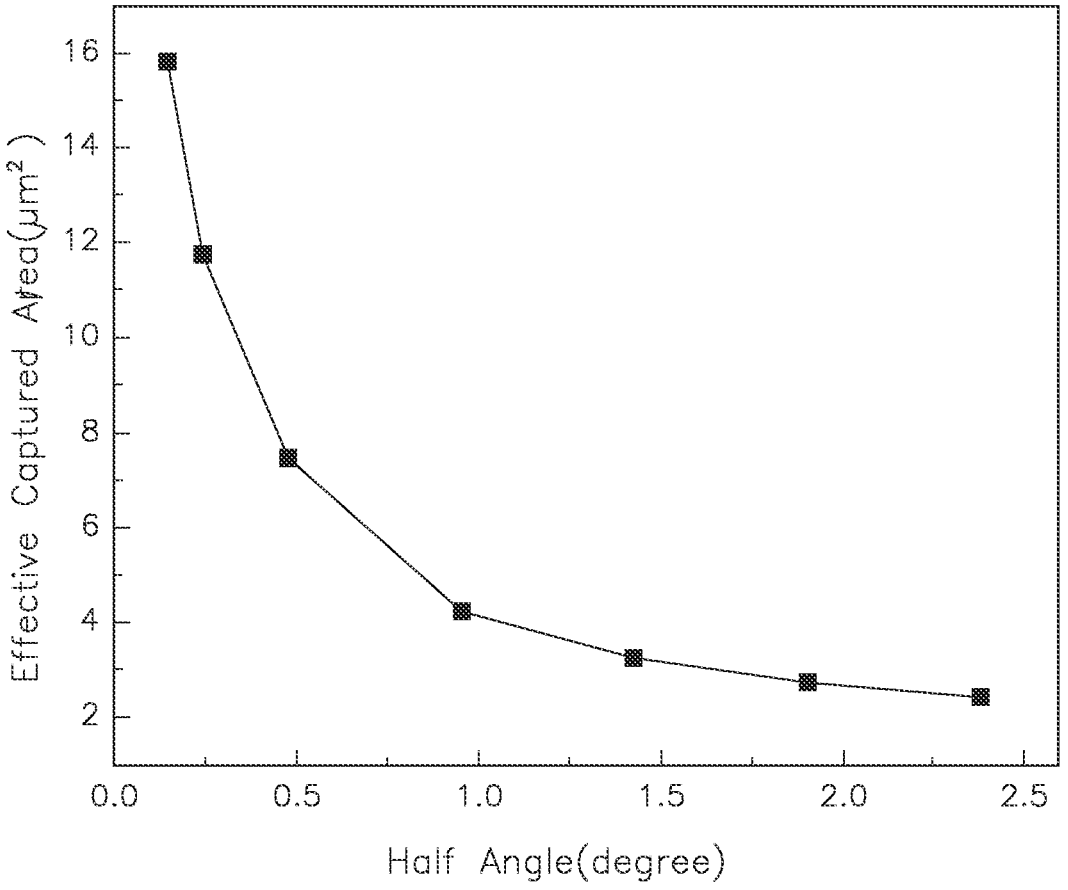
FIG. 1B is the schematic diagram of the angle of the shank part related to the effective captured gas area.

Referring to FIG. 1B, FIG. 1B is the schematic diagram of the angle of the shank part related to the effective captured gas area. FIG. 1B shows that the smaller the angle of the shank part is, the higher ion currents are, wherein the angle θ is defined as an intersection angle formed by the inclined line extended from the turning point of the radius of curvature R to the point corresponding to the diameter of the shank part 12 and the horizontal extension line extended from the turning point of the radius of curvature R. According to FIG. 1A and FIG. 1B, the present invention designs the structure of the emitter electrode for enhancing ion currents as follows.

Figure 2:
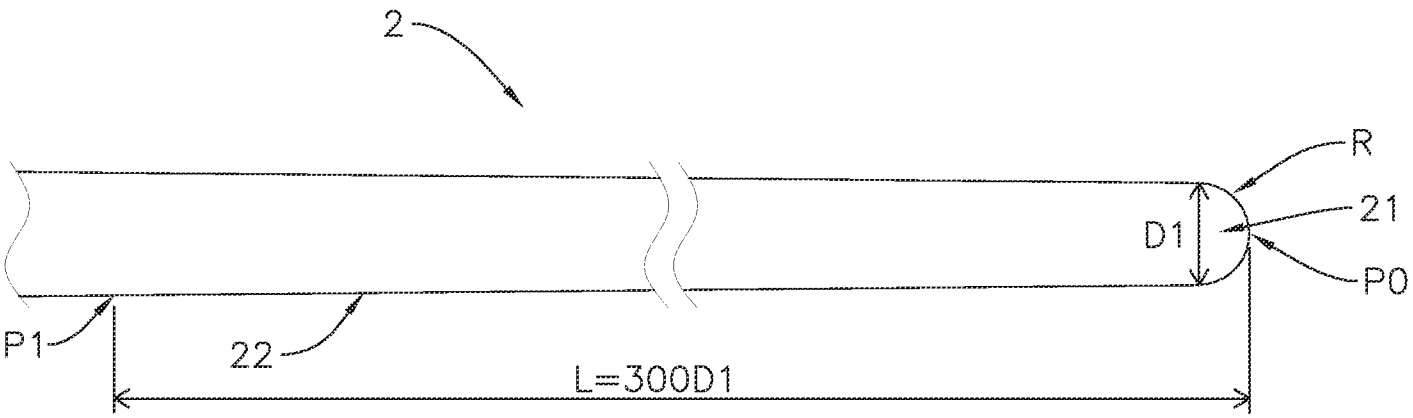
FIG. 2 is the schematic diagram of the structure of a part of the emitter electrode of the present invention.

Referring to FIG. 2, FIG. 2 is the schematic diagram of the structure of a part of the emitter electrode for enhancing ion currents of the present invention. The structure of the emitter electrode for enhancing ion currents 2 includes a tip end part 21 and a shank part 22. The tip end part 21 is formed at a front end of the structure of the emitter electrode 2 and has a pinpoint P0, a first diameter D1, and a radius of curvature R. The shank part 22 is formed in the rear of the tip end part at the front end of the structure of the emitter electrode 2. A length L of the tip end part 21 with the shank part 22 is from the pinpoint P0 to a first position P1 and a first distance between the first position P1 and the pinpoint P0 is 300 times of the first diameter D1. The radius of curvature R of the tip end part 21 ranges from 50 nanometers to 5 micrometers. The first diameter D1 ranges from 100 nanometers to 10 micrometers. The first diameter D1 is 2 times the radius of curvature R. Thereby, the ion currents generated by the structure of the emitter electrode for enhancing ion currents can be enhanced.

As mentioned above, the ion currents generated by the structure of the emitter electrode 2 relates to the angle θ. That is, the smaller the angle θ is, the higher the ion currents are. The angle θ corresponds to the diameter of the shank part 22. In fact, the method for manufacturing the structure of the emitter electrode 2 cannot extend the length of the shank part 22 without any limits to generate a uniform diameter of the shank part 22 to form a smaller angle θ. In other words, during the manufacturing process, the diameter of the shank part 22 corresponding to different length intervals is not constant. That is, the diameter of the shank part 22 at different length intervals is not uniform. However, FIG. 1B shows that to form the smaller angle θ at a length interval of the shank part 22, i.e. form a smaller diameter of the shank part 22, the ion currents generated by the structure of the emitter electrode for enhancing ion currents can be enhanced. A plurality of node positions corresponding to the diameter of the shank part 22 at each length interval will be described in the following embodiments.

Figure 3:
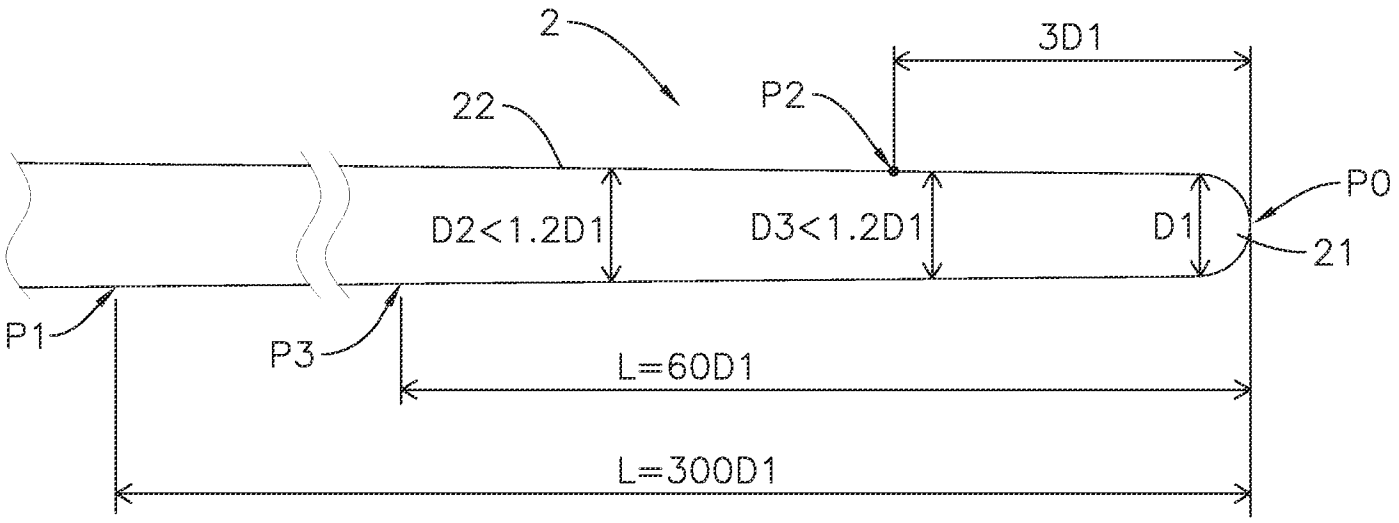
FIG. 3 is another schematic diagram of the structure of a part of the emitter electrode of the present invention.

Referring to FIG. 3, FIG. 3 is another schematic diagram of the structure of a part of the emitter electrode of the present invention. In the embodiment of the present invention, a second diameter D2 corresponding to at least one first node position between a second position P2 and a third position P3 at the shank part 22 is less than 1.2 times of the first diameter D1. A second distance between the pinpoint P0 and the second position P2 is 3 times of the first diameter D1. A third distance between the pinpoint P0 and the third position P3 is 60 times of the first diameter D1. Moreover, a third diameter D3 of the shank part 22 between the pinpoint P0 and the second position P2 is less than 1.2 times of the first diameter D1.

Figure 4:
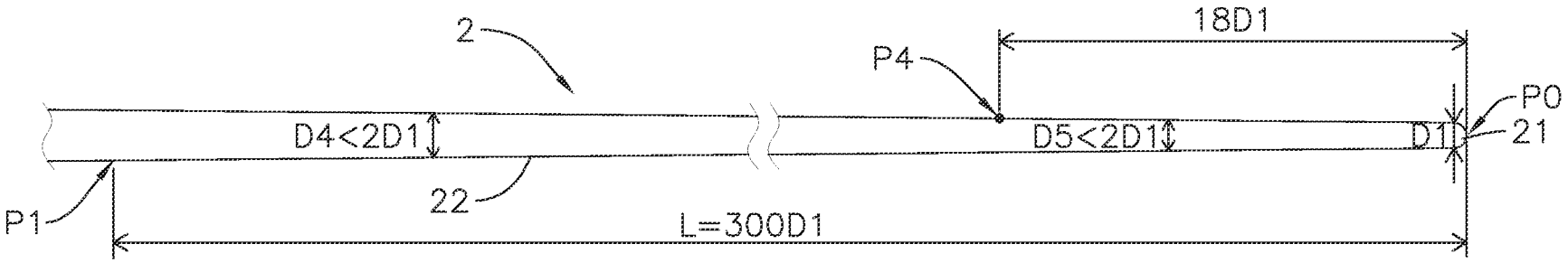
FIG. 4 is still another schematic diagram of the structure of a part of the emitter electrode of the present invention.
Figure 5A:
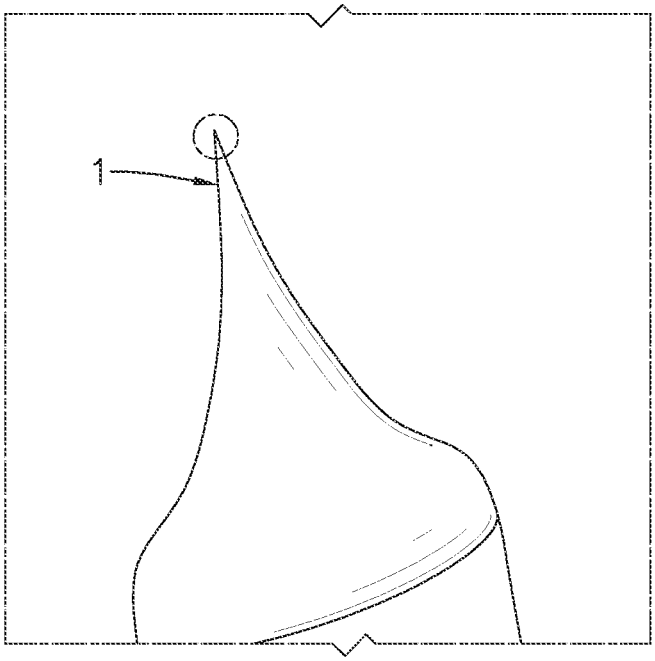
FIG. 5A is a schematic diagram of a structure of a common emitter electrode.
Figure 5B:
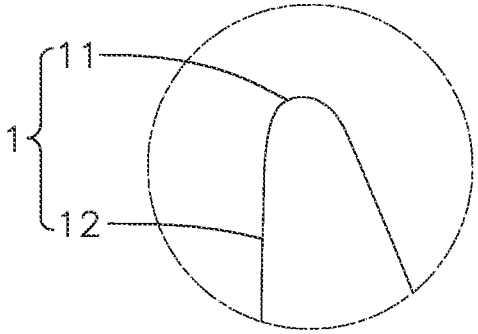
FIG. 5B is the enlarged image of the shank part with a tip end part and a shank part of FIG. 5A.
Figure 5C:
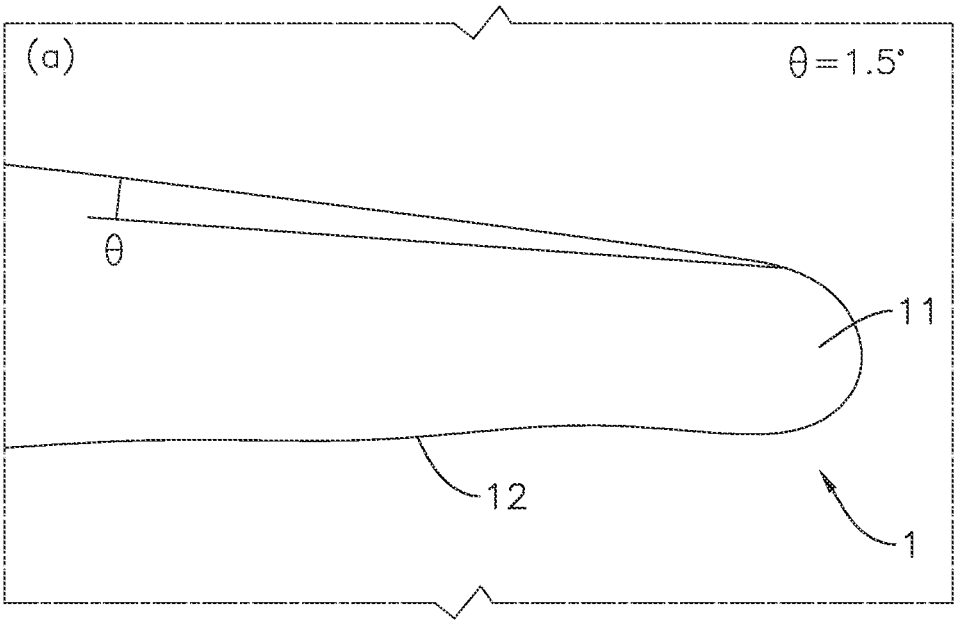
FIG. 5C is the enlarged image of the shank part at one angle.
Figure 5D:
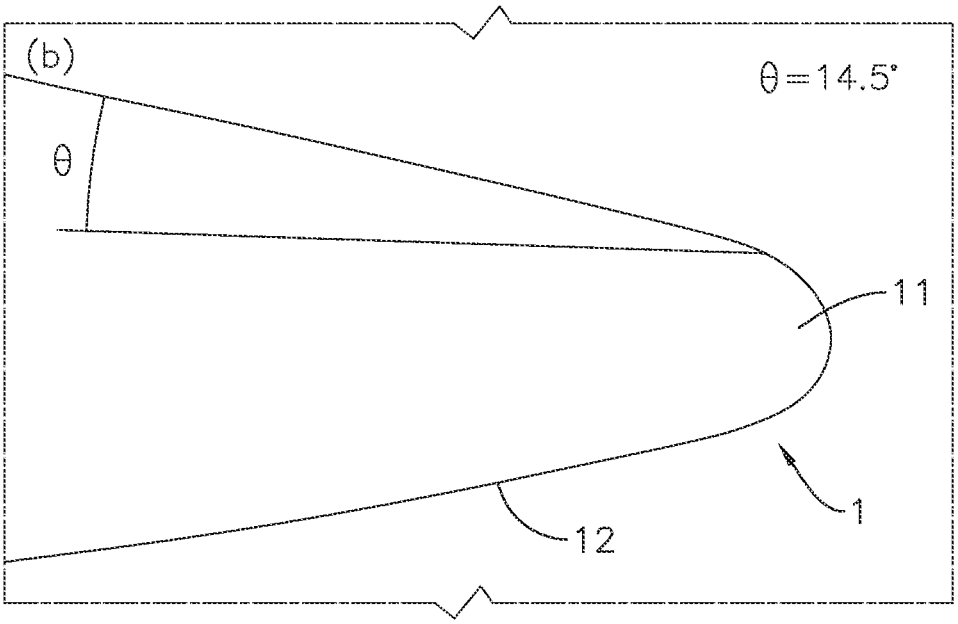
FIG. 5D is the enlarged image of the shank part at another angle.
Figure 5E:
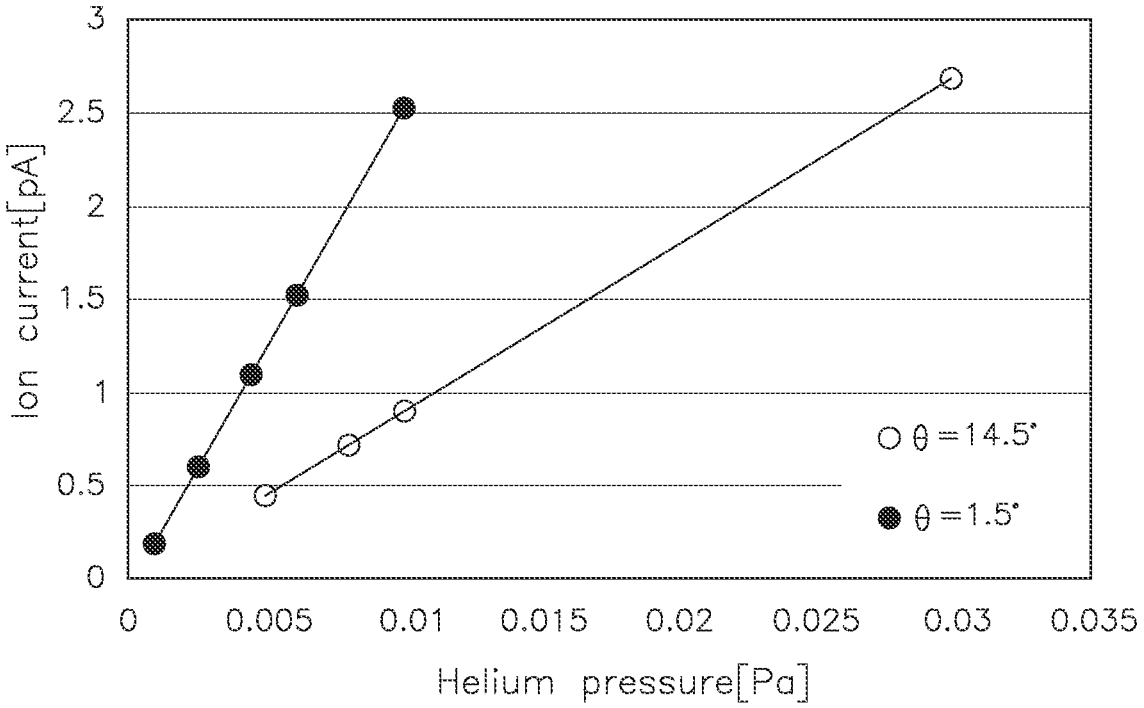
FIG. 5E is the schematic diagram of the shank part at the different angles at the Helium pressure related to the ion currents.

Referring to FIG. 4, FIG. 4 is another schematic diagram of the structure of a part of the emitter electrode of the present invention. In the embodiment of the present invention, the fourth diameter D4 corresponding to at least one second node position between a fourth position P4 and the first position P1 at the shank part 22 is less than 2 times the first diameter D1. A fourth distance between the pinpoint P0 and the fourth position P4 is 18 times the first diameter D1. Furthermore, a fifth diameter D5 of the shank part 22 between the pinpoint P0 and the fourth position P4 is less than 2 times of the first diameter D1.

Referring to Table 1 below, Table 1 shows the simulation and experiment result for the structure of the emitter electrode at different angles of the shank part. As mentioned above, the structure of the emitter electrode for enhancing ion currents 2 of the present invention has three features, including large radius of curvature R of the tip end part 21, and long length and flat angle of the shank part 22. The result proves that the smaller the angle of the shank part 22 of the emitter electrode 2 is, the larger the effective captured gas area is and the higher the ion currents are, wherein the tolerance with the radius of curvature R of the tip end part 21 can be ignored. Furthermore, according to the result, it shows that the ion currents generated by utilizing the structure of the emitter electrode of the present invention increases approximately 5 times.

TABLE 1

| | refrigerator temperature (k) | radius of curvature (nm) | angle of the shank part (°) | ion source | ion current @1e$^{-4}$ torr (pA) | effective captured gas area (μm$^2$) |
|---|---|---|---|---|---|---|
| (a) | 25 | 90.55 | ~16 | He | 10.6 | 2.3334 |
| (b) | 29 | 82.35 | ~0 | He | 53.3 | 12.3763 |

In summary, the structure of the emitter electrode for enhancing ion currents of the present invention has the features including large radius of curvature of the tip end part, long length of the shank part and flat angle of the shank part. Thereby, the ion current can be significantly increased from the scale of pico-amperes to the scale of the nano-amperes.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A structure of an emitter electrode for enhancing ion currents, comprising:

a tip end part, formed at a front end of the structure of the emitter electrode, having a pinpoint, a first diameter, and a radius of curvature; and a shank part, formed in a rear of the tip end part at the front end of the structure of the emitter electrode;

wherein a length of the tip end part with the shank part is from the pinpoint to a first position of the shank part, and a first distance between the first position and the pinpoint is 300 times of the first diameter;

wherein the radius of curvature of the tip end part ranges from 50 nanometers to 5 micrometers;

wherein the first diameter is 2 times of the radius of curvature.

2. The structure as claimed in claim 1, wherein there is at least one first node position between a second position and a third position of the shank part and a second diameter corresponding to the at least one first node position is less than 1.2 times of the first diameter;

wherein a second distance between the pinpoint and the second position is 3 times of the first diameter and a third distance between the pinpoint and the third position is 60 times of the first diameter.

3. The structure as claimed in claim 2, wherein a third diameter of the shank part between the pinpoint and the second position is less than 1.2 times of the first diameter.

4. The structure as claimed in claim 1, wherein there is at least one second node position between a fourth position and the first position of the shank part and a fourth diameter corresponding to the at least one second node position is less than 2 times of the first diameter;

wherein a fourth distance between the pinpoint and the fourth position is 18 times of the first diameter.

5. The structure as claimed in claim 4, wherein a fifth diameter of the shank part between the pinpoint and the fourth position is less than 2 times of the first diameter.

* * * * *